US009146520B2

(12) United States Patent
Fuse et al.

(10) Patent No.: US 9,146,520 B2
(45) Date of Patent: Sep. 29, 2015

(54) IMAGE FORMING APPARATUS

(71) Applicant: CANON KABUSHIKI KAISHA, Tokyo (JP)

(72) Inventors: Yasuhiko Fuse, Mishima (JP); Wataru Uchida, Yokohama (JP); Jun Agata, Suntou-gun (JP); Daisuke Takamura, Fujinomiya (JP); Masatoshi Yoshida, Susono (JP); Tomooku Koyama, Suntou-gun (JP); Taisuke Minagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/180,713

(22) Filed: Feb. 14, 2014

(65) Prior Publication Data

US 2014/0234001 A1 Aug. 21, 2014

(30) Foreign Application Priority Data

Feb. 18, 2013 (JP) ..... 2013-029062
Jan. 27, 2014 (JP) ..... 2014-012361

(51) Int. Cl.
*G03G 15/00* (2006.01)
*G03G 15/20* (2006.01)

(52) U.S. Cl.
CPC ..... *G03G 15/657* (2013.01); *G03G 15/2028* (2013.01); *G03G 15/505* (2013.01); *G03G 2215/00945* (2013.01); *G03G 2215/2045* (2013.01)

(58) Field of Classification Search
CPC ... G03G 15/00; G03G 15/657; G03G 15/505; G03G 15/2028; G03G 15/20; G03G 21/00; G03G 2215/2045; G03G 2215/00945
USPC ..... 399/400
See application file for complete search history.

(56) References Cited

U.S. PATENT DOCUMENTS

| | | | | |
|---|---|---|---|---|
| 6,027,269 | A | 2/2000 | Yoshida | |
| 6,058,287 | A * | 5/2000 | Haneda et al. | 399/397 |
| 6,169,875 | B1 * | 1/2001 | Tidrick | 399/400 |
| 6,178,017 | B1 * | 1/2001 | Ishida | 358/498 |
| 6,564,025 | B2 * | 5/2003 | Sameshima et al. | 399/68 |
| 6,952,556 | B2 | 10/2005 | Endo et al. | |
| 7,426,353 | B1 * | 9/2008 | Sakakibara | 399/68 |

(Continued)

FOREIGN PATENT DOCUMENTS

| | | | | |
|---|---|---|---|---|
| JP | 05119560 | A * | 5/1993 | G03G 15/00 |
| JP | 07181830 | A * | 7/1995 | G03G 15/20 |

(Continued)

*Primary Examiner* — Nguyen Ha
(74) *Attorney, Agent, or Firm* — Fitzpatrick, Cella, Harper & Scinto

(57) ABSTRACT

An image forming apparatus includes: a transfer portion for transferring an image onto a sheet at a transfer nip; a fixing portion for fixing the image on the sheet at a fixing nip; a sheet feeding guide, provided between the transfer portion and the fixing portion, having a sheet guide surface; a sheet detecting portion provided between the transfer portion and the fixing portion; and a controller for controlling a sheet feeding speed of at least one of the transfer portion and the fixing portion depending on an output of the sheet detecting portion so that a feeding attitude of the sheet sandwiched at both of the transfer nip and the fixing nip is maintained in a predetermined feeding attitude. The sheet guide surface of the sheet feeding guide has a most recessed region in a region between the transfer portion and the sheet detecting portion.

12 Claims, 12 Drawing Sheets

(56) References Cited

U.S. PATENT DOCUMENTS

| | | | | |
|---|---|---|---|---|
| 8,646,776 | B2 | 2/2014 | Agata et al. | |
| 8,668,198 | B2 | 3/2014 | Tsuji et al. | |
| 2002/0051660 | A1* | 5/2002 | Kobaru et al. | 399/320 |
| 2004/0131399 | A1* | 7/2004 | Sahara | 399/322 |
| 2005/0084302 | A1* | 4/2005 | Masuda et al. | 399/322 |
| 2006/0182479 | A1* | 8/2006 | Miyake | 399/400 |
| 2007/0264033 | A1 | 11/2007 | Koshida | |
| 2009/0297242 | A1* | 12/2009 | Kanematsu | 399/400 |
| 2011/0070002 | A1* | 3/2011 | Choi | 399/322 |
| 2012/0251195 | A1* | 10/2012 | Ueyama | 399/307 |
| 2012/0269531 | A1* | 10/2012 | Suzuki et al. | 399/67 |
| 2013/0100219 | A1 | 4/2013 | Tokisawa et al. | |
| 2013/0161901 | A1 | 6/2013 | Uchida et al. | |
| 2014/0126945 | A1 | 5/2014 | Uchida et al. | |

FOREIGN PATENT DOCUMENTS

| | | | | | |
|---|---|---|---|---|---|
| JP | 08151143 | A | * | 6/1996 | B65H 9/00 |
| JP | 10097154 | A | * | 4/1998 | G03G 15/00 |
| JP | 2007-052112 | A | | 3/2007 | |
| JP | 2007212588 | A | * | 8/2007 | G03G 15/20 |
| JP | 2007-308206 | A | | 11/2007 | |
| JP | 2011090092 | A | * | 5/2011 | G03G 15/00 |

* cited by examiner (a)

(b)

PRIOR ART

PRIOR ART

PRIOR ART

PRIOR ART (a) HOME POSITION (SENSOR OFF)

(b) IMMEDIATELY AFTER SENSOR ON (c) SENSOR ON

IMAGE FORMING APPARATUS

FIELD OF THE INVENTION AND RELATED ART

The present invention relates to an image forming apparatus such as a copying machine, a laser beam printer or a facsimile machine.

The image forming apparatus such as the copying machine, the laser beam printer or the facsimile machine is constituted so as to form an image on a sheet such as plain paper or resin-coated paper by using electrophotography in which a developer consisting of fine powder is controlled so as to be electrostatically attracted to the sheet.

Specifically, an electrostatic latent image is formed on another peripheral surface of a photosensitive drum or a photosensitive belt as an image bearing member and then is developed with a toner or the like as the developer to be visualized. The sheet is nipped and fed at a transfer nip of a transfer portion formed by the image bearing member and a transfer member. In a feeding process, a toner image on the image bearing member surface is transferred onto the sheet by the transfer member and then is carried on the sheet. The toner image is fixed on the sheet by applying heat and pressure to the sheet while nipping and feeding a sheet end, fed from the transfer portion, through a fixing nip of a fixing device (apparatus).

By successively performing these steps, the image is formed on the sheet.

As a fixing device for heat-fixing, on the sheet surface as a fixed image, an unfixed image (toner image), of intended image information, formed and carried on the sheet by a transfer type or a direct type, a fixing device of a heating roller type (heater roller type) or a film type has been put into practical use.

In the fixing device of the heating roller type, the fixing nip is formed by a fixing roller and a pressing roller, and the toner image is heated and fixed on the sheet while nipping and feeding the sheet, on which the unfixed toner image is carried, through the fixing nip. In the fixing device of the film type, the fixing nip is formed by a fixing film and the pressing roller, and the toner image is heated and fixed on the sheet while nipping and feeding the sheet, on which the unfixed toner image is carried, through the fixing nip.

In the above-described fixing devices, a temperature of the fixing device is kept at a predetermined temperature so as to heat-fix the toner image. However, the fixing device temperature varies depending on a thickness of the sheet introduced into (passed through) the fixing nip, a sheet feeding speed, a sheet interval during sheet passing of a plurality of sheets, and an operation state of the image forming apparatus. By the temperature change, an outer diameter of the fixing roller is changed, and therefore with this change, the feeding speed of the sheet passing through the fixing nip is also changed.

Here, when the sheet feeding speed at the fixing nip is slower than the sheet feeding speed at the transfer nip, excessive curve (also called a loop) is formed on the sheet between the fixing device and the transfer portion. Further, when such an excessive curve is formed, the unfixed toner image on the sheet contacts and rubs a sheet feeding guide provided between the fixing device and the transfer portion, so that image defect and image disorder during the transfer are caused.

On the other hand, when the sheet feeding speed at the fixing nip is faster than the sheet feeding speed at the transfer nip, the sheet is in a tension state between the fixing device and the transfer portion. For that reason, in some cases, the image on the sheet is elongated and disorder of the unfixed toner image is caused by an impact when a trailing end of the sheet comes out of the transfer portion.

Therefore, as one of methods for solving the above problems, as disclosed in Japanese Patent No. 4795110, a detecting means for detecting a curve amount of the sheet (hereinafter referred to as a curve sensor) is provided at a central portion, with respect to a sheet width direction perpendicular to the sheet feeding direction, between the transfer portion and the fixing device. Then, on the basis of an output signal of the curve sensor, sheet feeding speed control at the fixing portion and the transfer portion is effected, so that the sheet is fed while maintaining the curve amount in a proper state.

Further, as one of problems which cannot be solved by the above-described image forming apparatus, there is a phenomenon of non-uniform curve feeding such that the curve amount is different with respect to the sheet width direction.

By the influence of the type of the sheet and a specific fixing condition or with a difference in amount per unit area of the toner image or a difference in pressure balance at the transfer portion with respect to the sheet width direction, when a difference in timing when a leading end of the sheet enters the fixing nip is generated between left and right portions, the sheet causes the non-uniform curve. When the non-uniform curve is generated, an attitude of the sheet is disordered, so that the non-uniform curve state cannot be accurately detected by the curve sensor disposed at only the widthwise central portion of the sheet. For that reason, proper control of the curve amount cannot be effected, so that the sheet is slewing-fed by landing thereof on a feeding guide in one side, and generation of creases and generation of scattering of the toner image by an impact during elimination of the curve were caused.

Therefore, as a method for solving the problems, as disclosed in Japanese Laid-Open Patent Application (JP-A) 2007-52112, a plurality of curve sensors are provided, with respect to the sheet width direction, inside the feeding guide between the transfer portion and the fixing device. In this method, even when the non-uniform curve is generated on the sheet, the attitude of the sheet is detected by any of the plurality of curve sensors, and on the basis of a result of the detection, the sheet feeding speed in the fixing device is switched to control the curve amount.

However, in this method, the plurality of the sensors are required, thus leading to an increase in cost.

SUMMARY OF THE INVENTION

The present invention has been accomplished in view of the above-described problems. A principal object of the present invention is to provide an image forming apparatus capable of stabilizing a sheet feeding attitude with a simple constitution.

According to an aspect of the present invention, there is provided an image forming apparatus comprising: a transfer portion for transferring an image onto a sheet while feeding the sheet through a transfer nip; a fixing portion for fixing the image on the sheet while feeding the sheet, fed from the transfer portion, through a fixing nip; a sheet feeding guide, provided between the transfer portion and the fixing portion, having a guide surface for guiding feeding of the sheet; a sheet detecting portion, provided at a position between the transfer portion and the fixing portion, for detecting the sheet; and a controller for controlling a sheet feeding speed of at least one of the transfer portion and the fixing portion depending on an output of the sheet detecting portion so that a feeding attitude of the sheet fed while being sandwiched at both of the transfer nip and the fixing nip is maintained in a predetermined feeding attitude, wherein the guide surface of the sheet feeding guide has a most recessed region in a region between the transfer portion and the sheet detecting portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings. Although the following embodiments are preferred embodiments of the present invention, the present invention is not limited to the following embodiments. Within the scope of the present invention, various constituent elements can be replaced with other known constituent elements.

Embodiment 1

(1) Image Forming Apparatus

An image forming apparatus forms an image on a recording material (hereinafter referred to as a sheet), such as plain paper or an OHP sheet of various types having regular and irregular sizes, by using an appropriate image forming process, and then outputs an image-formed product.

Figure 7:
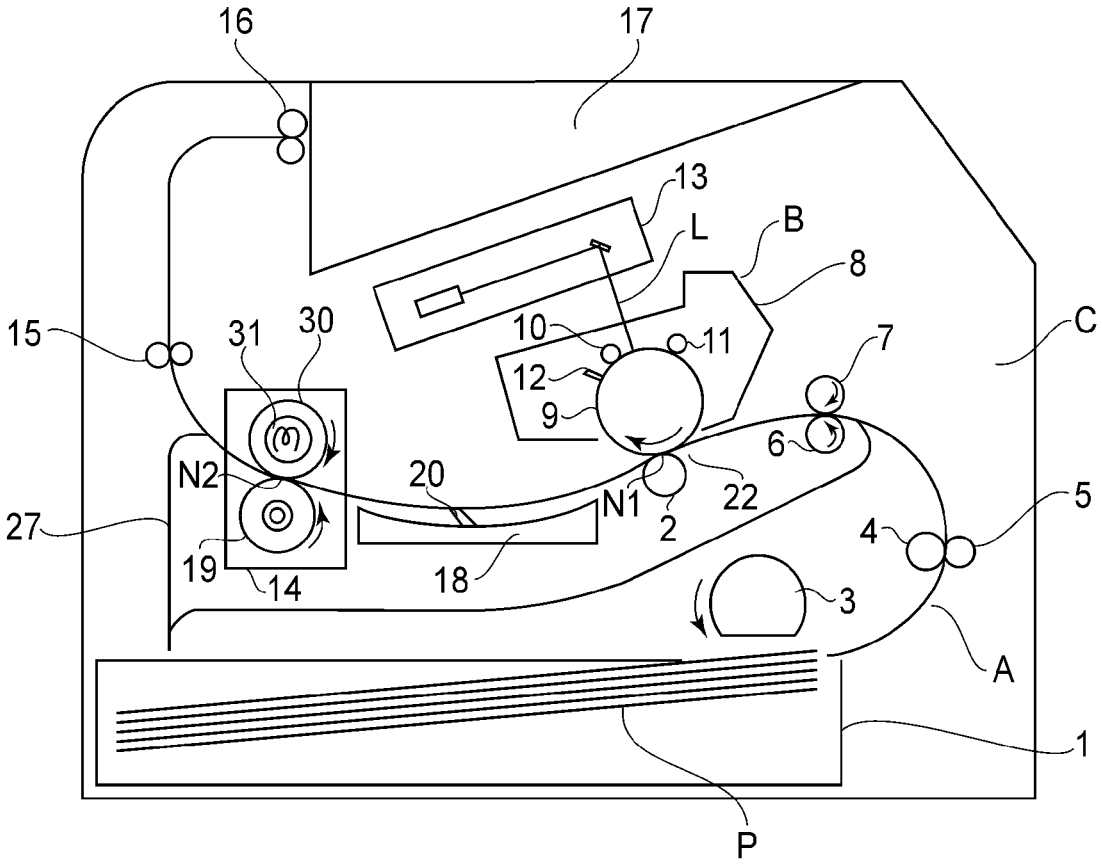
FIG. 7 is a schematic illustration of the image forming apparatus.

FIG. 7 is a schematic front view of an example of the image forming apparatus according to this embodiment.

The image forming apparatus in this embodiment is an ordinary image forming apparatus including a sheet feeding guide, and is a laser beam printer using an electrophotographic process.

The image forming apparatus in this embodiment includes a sheet feeding portion A, an image forming portion B, a fixing portion 14 and the like.

In the image forming portion B, a process cartridge 8 is detachably mounted in an image forming apparatus main assembly C constituting a casing of the image forming apparatus. The process cartridge 8 is constituted by integrally assembling a drum-shaped electrophotographic photosensitive member as an image bearing member (hereinafter referred to as a photosensitive drum) 9, a charger 10, a developing device 11, a cleaner 12 and the like into a unit. The charger 10 electrically charges the photosensitive drum 9. The developing device 11 develops an electrostatic latent image on the photosensitive drum 9 with a toner. The cleaner 12 removes a residual toner remaining on the photosensitive drum 9, and the residual toner is accommodated in a residual toner chamber (not shown).

The photosensitive drum 9 is rotationally driven in an arrow direction at a predetermined peripheral speed. The charger 10 uniformly charges an outer peripheral surface of the rotating photosensitive drum 9 to a predetermined polarity and a predetermined potential. Laser light L subjected to ON/OFF modulation corresponding to image information to be printed is outputted from a laser scanner unit 13 as an exposure device, so that the charged surface of the photosensitive drum 9 is subjected to main scanning exposure. As a result, the electrostatic latent image corresponding to the image information to be printed is written (formed) on the surface of the rotating photosensitive drum 9. This electrostatic latent image is developed, as a toner image, with the toner by the developing device 11.

On the other hand, sheets P stacked on a sheet mounting table in a sheet feeding tray 1 are picked up from an uppermost sheet one by one by rotation of a sheet feeding roller 3, and then the picked-up sheet P is fed to a registration portion by feeding rollers 4 and 5. The sheet P is subjected to uniformization of a feeding direction thereof at the registration portion consisting of registration rollers 6 and 7, and thereafter is gradually fed to a transfer portion 22 constituted by the photosensitive drum 9 and a transfer roller 2.

At the transfer portion 22, a transfer nip N1 is formed by the surface of the photosensitive drum 9 and the surface of the transfer roller 2, and the sheet P is nipped and fed through the transfer nip N1. Further, in a feeding process of the sheet P, the toner image on the surface of the photosensitive drum 9 is transferred onto the sheet P by a transfer bias applied to the transfer roller 2. The sheet P after the toner image transfer thereon is completed is gradually fed to a fixing nip N2 roughly along a sheet feeding guide 18 provided between the transfer portion 22 and the fixing portion 14.

At the fixing portion 14, the fixing nip N2 is formed by a cylindrical fixing roller (rotatable heating member) 30 and a pressing roller (rotatable pressing member) 19, and the sheet P fed from the transfer portion 22 is nipped and fed through the fixing nip N2. Further, in a feeding process of the sheet P, heat of the fixing roller 30 heated by a halogen lamp 31 provided inside the fixing roller 30 is applied to the sheet P to melt the toner image, so that the toner image is fixed on the sheet P by pressure at the fixing nip N2.

Figure 8:
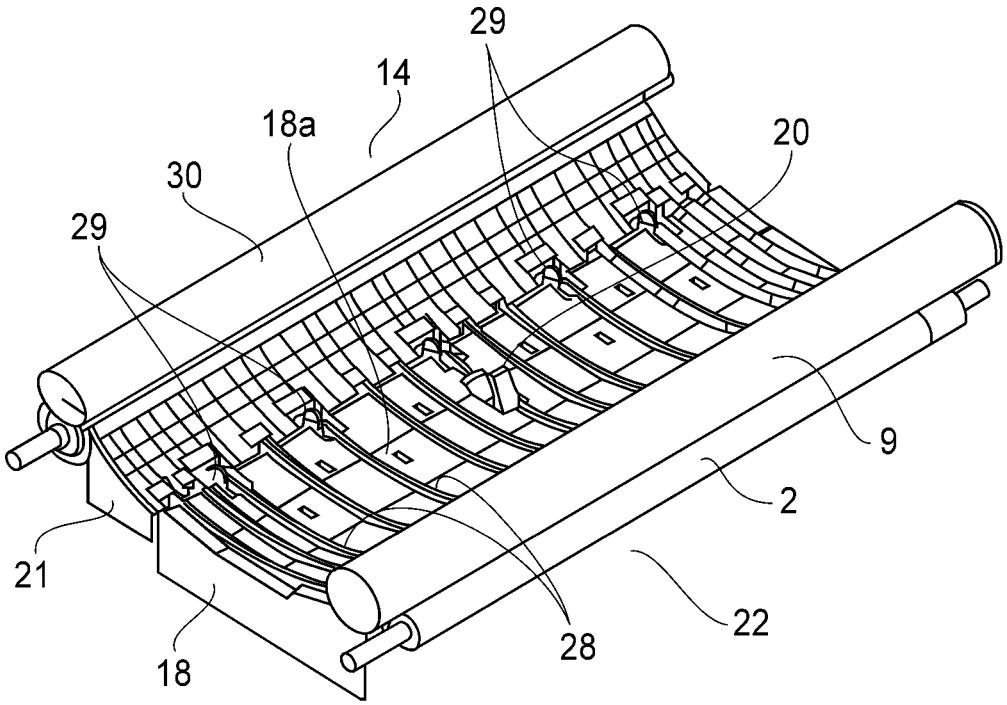
FIG. 8 is a perspective view of a sheet feeding guide in Comparison Example.
Figure 16:
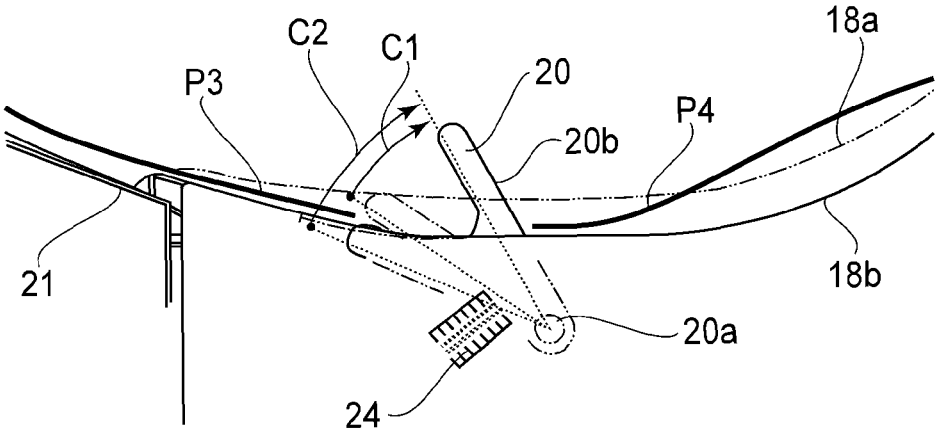
FIG.16 PRIOR ART
FIG. 16 is a schematic view for illustrating a behavior of a curve sensor before and after the guide surface of the sheet feeding guide is changed.
Figure 18:
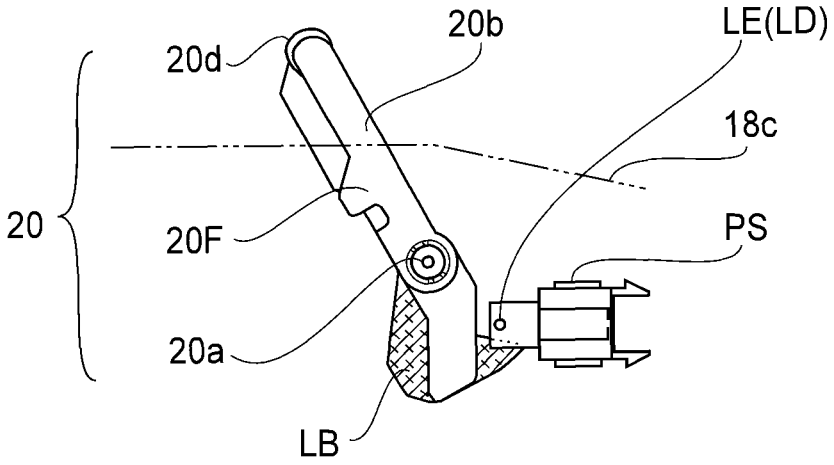
In FIG. 18, (a) to (c) are schematic views each for illustrating a structure of the curve sensor (sheet detecting sensor).
Figure 18:
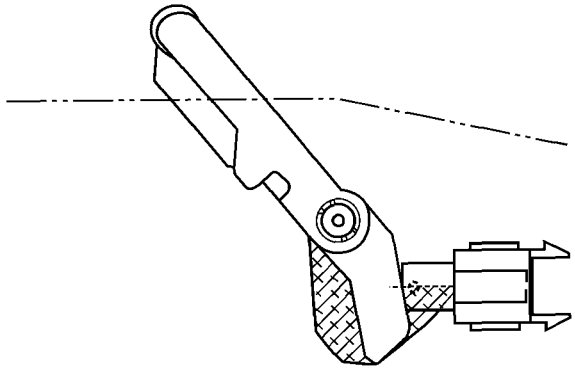
Figure 18:
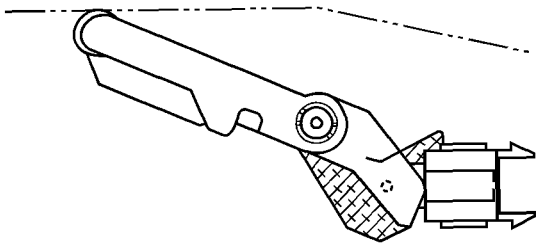

When the sheet P is fed from the transfer portion 22 to the fixing portion 14, a curve sensor (sheet detecting portion) 20 provided inside the sheet feeding guide 18 is constituted to fall white following sliding with the sheet P. The curve sensor 20 is used for detecting a curved state (feeding attitude) of the sheet P generated by a difference in feeding speed of the sheet P between the transfer nip N1 and the fixing nip N2. The curve sensor 20 has a structure as shown in FIG. 18 and includes a photo-sensor PS and a flag portion 20F rotatable in contact with the sheet P. The photo-sensor PS includes an emitting portion LE for emitting the light and a light receiving portion LD for receiving the light, and a state in which the light from the emitting portion LE reaches the light receiving portion LD is a sensor OFF state (i.e., a state in which a controller 100 recognizes no sheet as described later). The flag portion 20F is provided with a contact portion 20*b* to which the sheet P is contacted, a rotation shaft 20*a* and a light blocking portion LB for blocking the light from entering the light receiving portion LD of the photo-sensor PS. The flag portion 20F is urged toward a home position by a spring 24 as shown in FIG. 16. Accordingly, before the sheet P abuts against the flag portion 20F, the flag portion 20F is kept in an attitude (home position) shown in (a) of FIG. 18, and when the sheet P abuts against the flat portion 20F, the flag portion 20F is gradually rotated about the shaft 20*a* into attitudes shown in (b) and (c) of FIG. 18. When the contact with the sheet P is eliminated, the attitude of the flag portion 20F is returned from the attitude of (c) of FIG. 18 to the attitude of (a) of FIG. 18 by the urging force of the spring 24. Each of (b) and (c) of FIG. 8 shows a state in which the light blocking portion LB blocks the incidence of the light into the light receiving portion LD, and this state is a sensor ON state (i.e., a state in which the controller 100 recognizes the presence of the sheet P). The attitude of the flag portion 20F shown in (b) of FIG. 18 is an attitude immediately after the light blocking portion LB blocks the light and is an attitude of a boundary of turning-on of the sensor. The sensor is in an ON state from this attitude to the attitude of (c) of FIG. 18.

Here, with reference to FIG. 1, a control system for controlling the sheet feeding speed at each of the transfer portion 22 and the fixing portion 14 will be described. An output signal from the photo-sensor PS is fetched into a feeding speed controller (control means) 100 constituted by a CPU and memories such as ROM and RAM. The feeding speed controller 100 effects, on the basis of the output signal, control of either one or both of a transfer portion driving motor M1 and a fixing portion driving motor M2, so that the sheet feeding speed in at least one of the transfer portion 22 and the fixing portion 14.

In this way, by changing the sheet feeding speed, the sheet P is fed so as to be maintained at a control point of the curve sensor 20.

Specifically, when the sheet P in a sandwiched state between the fixing portion 14 and the transfer portion 22 turns on the sensor 20, the sensor 20 is in an excessively loosen state, and therefore the sheet feeding speed in at least one of the transfer portion 22 and the fixing portion 14 is changed so as to eliminate the loosening of the sheet P. Thereafter, when the sensor 20 is turned off, the sheet P is in an excessively less state of the loosening of the sheet P, and therefore the sheet feeding speed in at least one of the transfer portion 22 and the fixing portion 14 is changed so as to loosen the sheet P. Such control in which the turning-on and the turning-off of the sensor 20 are repeated is effected, and therefore the attitude of the flag portion 20F shown in (b) of FIG. 18 is the control point (boundary of speed adjustment). Further, a sheet feeding attitude as a control target is Ptarget shown in of FIG. 1, and the attitude of the flag portion 20F in this feeding attitude corresponds to the attitude shown in (b) of FIG. 18.

The sheet P passing through the fixing portion 14 is discharged onto a sheet discharge tray 17 provided at an upper portion of an apparatus main assembly C by an intermediary sheet discharging roller pair 15, a sheet discharging roller pair 16, and the like.

An operation when one-side printing on the sheet P is performed is as described above.

When double-side printing on the sheet P is performed, the sheet P is introduced into a feeding path 27 for double-side printing by a feeding path switching mechanism (not shown) provided downstream of the fixing portion 14 with respect to a recording material (sheet) feeding direction. Then, in the feeding path 27, a switch-back operation of the sheet P is performed, so that the sheet P is turned upside down and then is fed again to the registration portion.

The sheet P fed to the registration portion is, after the feeding direction thereof is uniformized by the registration rollers 6 and 7, fed to the transfer portion 22. Then, the toner image is transferred from the surface of the photosensitive drum 9 onto the sheet P at the transfer nip N1 of the transfer portion 22, and thereafter the sheet P is fed to the fixing portion 14. Then, the toner image transferred from the surface of the photosensitive drum 9 is heat-fixed on the sheet P at the fixing nip N2 of the fixing portion 14.

The sheet P passing through the fixing portion 14 is discharged onto the sheet discharge tray 17 provided at the upper portion of the apparatus main assembly C by the intermediary sheet discharging roller pair 15, the sheet discharging roller pair 16, and the like.

(2) Structure of Sheet Feeding Guide 17 in Comparison Example

A constitution of a sheet feeding guide 18, in Comparison Example, for guiding the sheet P from the time when the sheet P passes through the transfer portion 22 to the time when the sheet P enters the fixing portion 14 will be described.

FIG. 8 is a perspective view of the sheet feeding guide 18 in Comparison Example as seen from obliquely above the sheet feeding guide 18 in the upstream side of the sheet feeding direction.

The sheet feeding guide 18 has a guide surface 18*a* for guiding the feeding of the sheet P, and the guide surface 18*a* is constituted by a curved surface smoothly connecting the transfer portion 22 and the fixing portion 14. The guide surface 18*a* is provided with a plurality of ribs 28 provided in parallel along the sheet feeding direction thereof, and by a shape of the ribs, the guide surface 18*a* is configured to be decreased in contact surface with the back surface of the sheet P.

At a central portion of the sheet feeding guide 18 with respect to a direction perpendicular to the sheet feeding direction, a curve sensor (sheet detecting portion) 20 is provided. The curve sensor 20 is set so as to be in stand-by in a predetermined position (home position) where the curve sensor 20 is projected from the guide surface 18*a* in a certain amount by a spring 24. Further, the curve sensor 20 is rotatable with the slide of the sheet P.

In a downstream side of the sheet feeding guide 18 with respect to the sheet feeding direction, a plurality of rollers 29 are provided smoothly rotatably over a widthwise direction of the sheet P. These rollers 29 not only have the function of smoothly delivering the sheet P to an entrance guide 21 toward the inside of the fixing portion 14 but also reduce a degree of abrasion of the ribs 28 due to sliding between the sheet feeding guide 18 and the back surface of the sheet P.

Next, with reference to FIGS. 9 and 10, a behavior of the sheet P passing through the sheet feeding guide 18 in Comparison Example will be described in detail.

Figure 9:
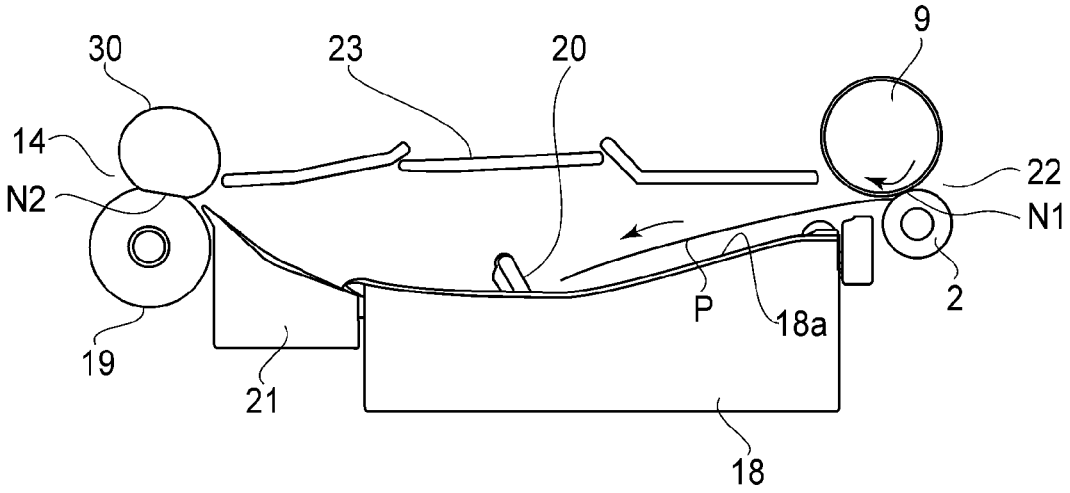
FIG.9 PRIOR ART
FIGS. 9 and 10 are schematic views for illustrating a behavior of a sheet passing through the sheet feeding guide in Comparison Example.
Figure 10:
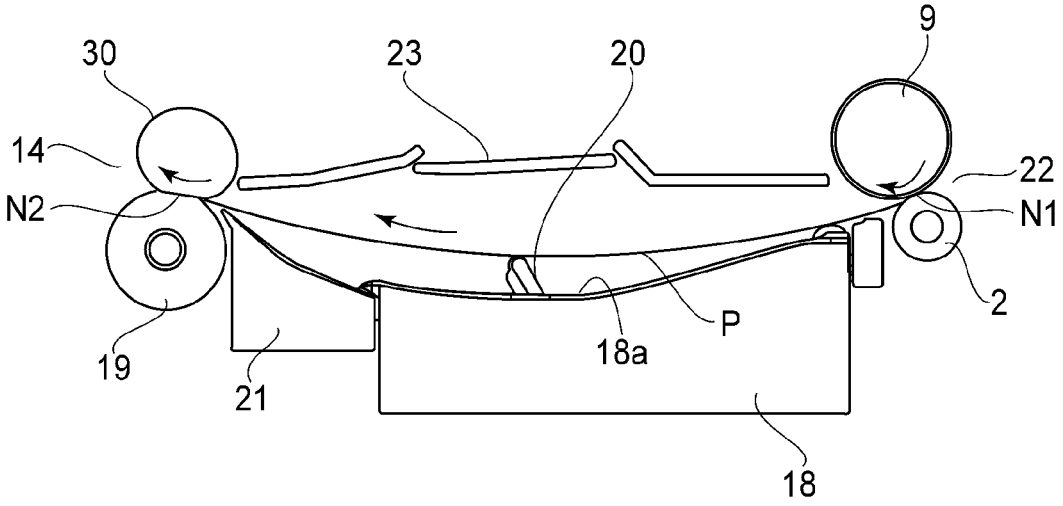

FIG. 9 is a schematic view showing the behavior of the sheet P passing through the sheet feeding guide 18 in Comparison Example. In FIG. 9, between the transfer portion 22 and the fixing portion 14, the sheet feeding guide 18 having the guide surface 18*a* as a smoothly curved surface and the entrance guide 21 for introducing the sheet P into the fixing nip N2 are provided. Further, above the guide surface 18*a* of the sheet feeding guide 18, an upper feeding guide 23 for regulating the feeding of the sheet P into the fixing nip N2 is provided.

As shown in FIG. 9, the sheet P on which an unfixed toner image (not shown) transferred at the transfer portion 22 is carried is fed roughly along the guide surface 18*a* of the sheet feeding guide 18. When the sheet P is further fed, the sheet P passes through the curve sensor 20 and the entrance guide 21 and then is nipped at the fixing nip N2 to be placed in a state as shown in FIG. 10. At this time, the curve sensor 20 contacts the back surface (opposite from the unfixed toner image-carrying surface) of the sheet P. Then, the feeding speed controller 100 adjusts the sheet feeding speed at the fixing portion 14 so as to maintain the control point of the curve sensor 20 and thus intends to feed the sheet P while maintaining the sheet attitude in the target attitude by the transfer nip N1 and the fixing nip N2.

However, at this time, in some cases, the above-described phenomenon of the non-uniform curve of the sheet P occurs. This phenomenon occurs in the case where a difference in entrance timing of the sheet P between left and right leading end corner portions of the sheet P is generated by the influence of the type of the sheet P and a fixing condition or with a difference in amount per unit area of the toner image between left and right end portions of the sheet P with respect to the sheet widthwise direction or with a difference in pressure balance at the transfer portion.

Figure 11:
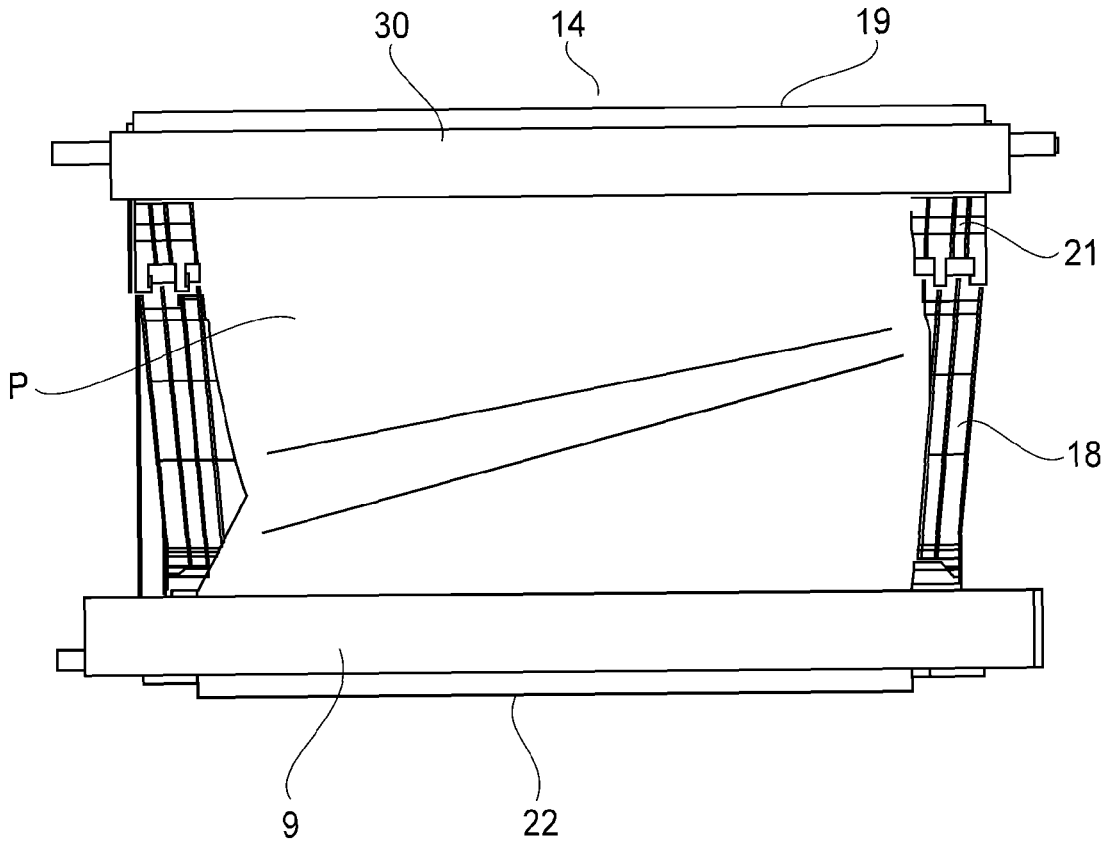
FIG. 11 is a schematic view for illustrating non-uniform curve of a sheet.

FIG. 11 shows an example of a state in which the sheet P causes the non-uniform curve. FIG. 11 is a top plan view of the sheet P as seen from above the sheet feeding guide 18 shown in FIG. 10. In FIG. 11, a state of the case where the right-side corner portion of the leading end of the sheet P enters the fixing nip N2 earlier is shown, thus assuming a state such that the sheet P is obliquely distorted (non-uniformly curved state).

Figure 12:
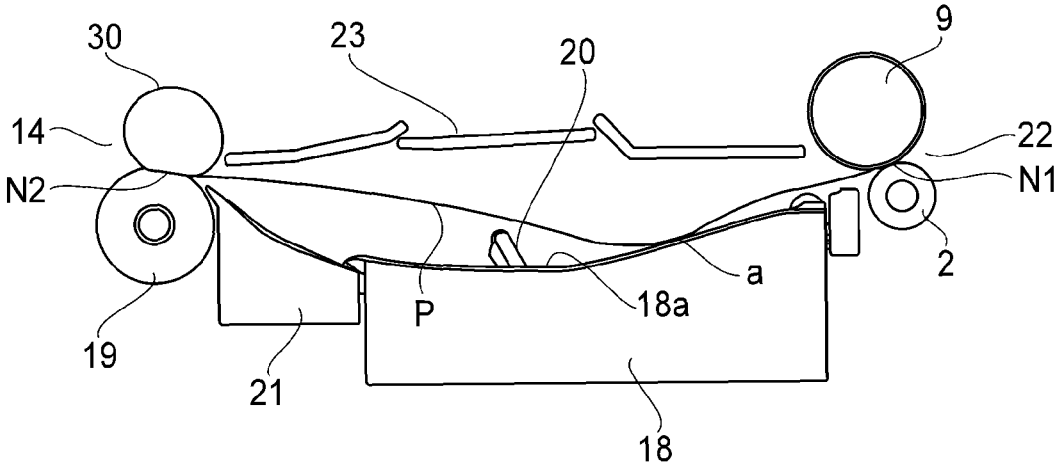
FIG.12 PRIOR ART
FIG. 12 is a schematic view for illustrating an example of contact of the sheet causing the non-uniform curve with the sheet feeding guide.
Figure 13:
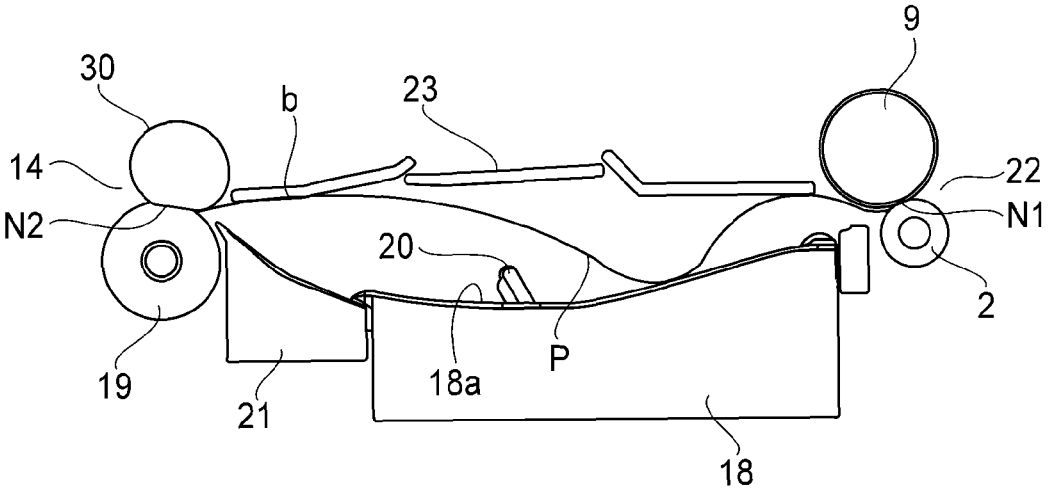
FIG. 13 is a schematic view for illustrating the case where the non-uniform curve of the sheet is accelerated.

FIG. 12 shows an example of contact of the sheet P, causing the non-uniform curve with the sheet feeding guide 18. When the non-uniform curve is generated on the sheet P, a part of the sheet P contacts the guide surface 18*a* of the sheet feeding guide 18 in some cases although the part should be originally floated from the guide surface 18*a* ("a" in FIG. 18). At this time, the sheet P and the curve sensor 20 are spaced from each other. In such a state, with respect to the control of the curve sensor 20, the feeding speed controller 100 discriminates that the fixing portion 14 pulls the sheet P more than necessary, and increases the sheet feeding speed at the fixing portion. As a result, the state of the non-uniform curve becomes worse, and the sheet P is further flexed over the guide surface 18*a* as shown in FIG. 13, so that the unfixed toner image-carrying surface of the sheet P slides with the upper feeding guide 23 ("b" in FIG. 13) and thus image defect occurs. FIG. 13 is an illustration of the case where the non-uniform curve of the sheet P is accelerated.

As described above, a process until the non-uniform curve of the sheet P causes the image defect problem includes:

1) The non-uniformly curved portion of the sheet P contacts the guide surface 18*a* of the sheet feeding guide 18, 2) The attitude of the sheet P is disordered by the contact with the guide surface 18*a* to space the sheet P from the curve sensor 20, and 3) The curve sensor 20 erroneously detects the attitude of the sheet P, so that the non-uniform curve is further accelerated.

The sheet P shown in FIG. 13 shows a profile of the sheet P at the right-side end portion with respect to the widthwise direction of the sheet P, and the sheet P is distorted in actuality, and therefore is not uniform with respect to the widthwise direction of the sheet P. In either case, it is characterized that a portion where a distance between the sheet P and the sheet feeding guide 18 when the non-uniform curve is generated is closest is either one of the left and right end portions with respect to the widthwise direction of the sheet P.

The generation of such non-uniform curve is conspicuous with an increasing size of the sheet P, for the reason such as constraint of the structure of the image forming apparatus or the like, it is difficult to prevent the generation of the non-uniform curve in many cases.

(3) Structure of Sheet Feeding Guide 18 in Embodiment 1

Therefore, in Embodiment 1, a constitution in which the sheet P does not contact the sheet feeding guide 18 even when the sheet P causes the non-uniform curve was employed. Specifically, the guide surface 18*a* of the sheet feeding guide 18 was set at a low level so as not to cause separation of the sheet P from the curve sensor 20 due to the contact of the sheet P with the sheet feeding guide 18.

Figure 14:
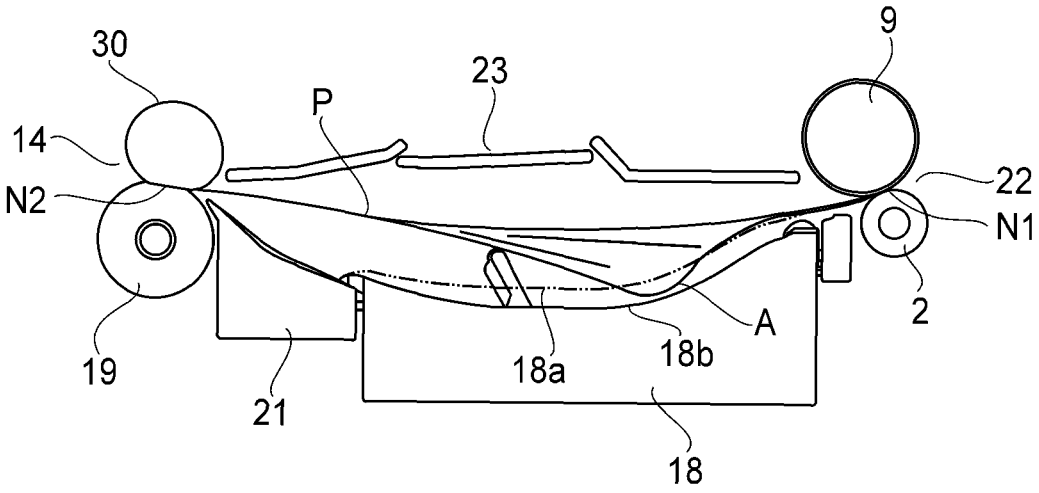
FIG.14 PRIOR ART
FIG. 14 is an illustration of the sheet feeding guide constituted so as not to contact the sheet causing the non-uniform curve.

FIG. 14 is a schematic view showing the sheet feeding guide 18 configured to prevent the speed P causing the non-uniform curve from contacting the sheet feeding guide 18. In FIG. 14, the guide surface 18*a* of the sheet feeding guide 18 in the constitution of Comparison Example is also indicated by a chain double-dashed line. As shown in FIG. 14, the flexed portion ("A" in FIG. 14) of the non-uniform curved sheet P is positioned below the guide surface indicated by the chain double-dashed line as the guide surface 18*a* in Comparison Example, but does not reach a guide surface 18*b* in Embodiment 1 indicated by a solid line. In this state, there is no extreme disorder of the attitude of the sheet P, and therefore the curve sensor 20 follows the sliding with the back surface of the sheet P. As a result, the sheet feeding speed control at the fixing portion 14 is properly effected, and thus there is no generation of the acceleration of the non-uniform curve.

As described above, with a lower guide surface, a degree of tolerance with respect to the non-uniform curve becomes larger, but it is preferable that the lowering level of the guide surface is limited to a necessary minimum level since a large lowering level leads to upsizing of the image forming apparatus. In this embodiment, the level of the guide surface 18*b* was set so as to be lower than that of the guide surface 18*a* in Comparison Example by about 5 mm at the maximum.

Figure 15:
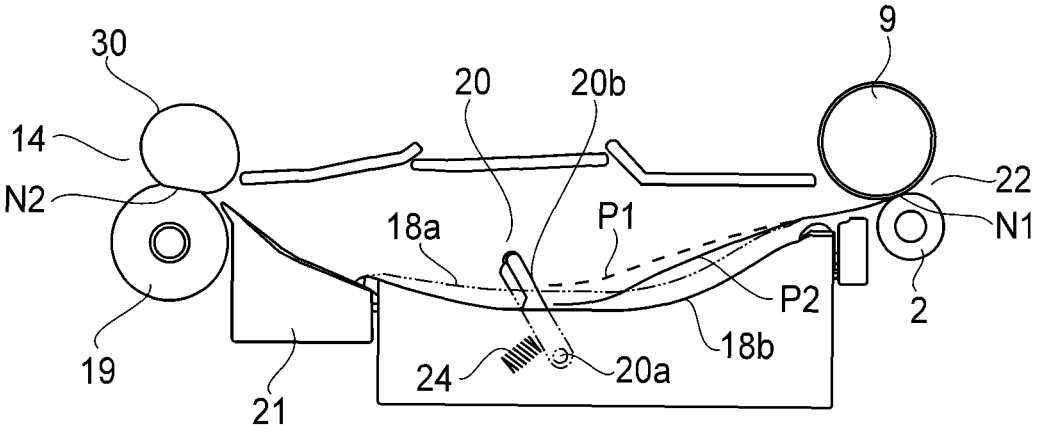
FIG. 15 is a schematic view for illustrating a behavior of a sheet end before and after a guide surface of the sheet feeding guide is changed.

On the other hand, by lowering the guide surface of the sheet feeding guide 18, also a feeding path of the leading end of the sheet P is changed. FIG. 15 shows a behavior of the leading end of the sheet P (sheet end) before and after the change in level of the guide surface of the sheet feeding guide 18. The sheet end feeding path before the change is represented by a broken line P1, and the sheet end feeding path after the change is represented by a solid line P2.

As shown in FIG. 15, the feeding path of the sheet end passing through the transfer portion 22 in this embodiment assumes a behavior such that the sheet end moves along the feeding path lower than the guide surface in Comparison Example. At this time, the sheet end contacts the upstream surface 20*b* of the curve sensor 20 with respect to the sheet feeding direction. The shaft 20*a* is a rotation supporting point of the curve sensor 20. The curve sensor 20 (flag portion 20F) is urged by the spring (elastic member) 24 in a direction opposite to the sheet feeding direction, so that the sheet P moves against a spring force of the spring 24 while rotating the curve sensor 20 in the sheet feeding direction. That is, compared with the guide surface 18*a* before the change in level, a force necessary to pass the sheet P through the curve sensor 20 is increased.

Figure 17:
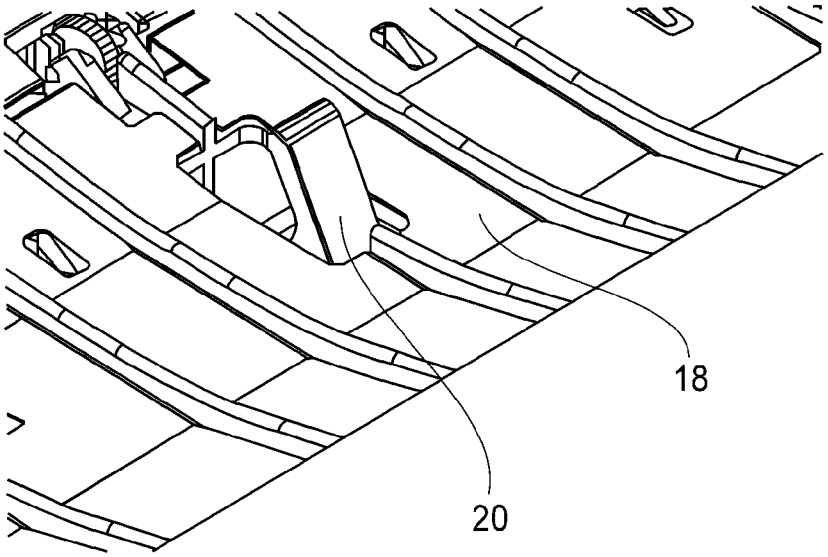
FIG. 17 is an enlarged perspective view of the curve sensor positioned in a stand-by position.

FIG. 16 shows a behavior of the curve sensor 20 before and after the change in level of the guide surface of the sheet feeding guide 18. FIG. 17 is an enlarged perspective view of the curve sensor 20 positioned in a stand-by position.

As shown in FIG. 16, after a trailing end of a (preceding) sheet P3 passes through the curve sensor 20, the curve sensor 20 is returned to the stand-by position (indicated by a solid line in FIG. 16) by the spring force of the spring 24 (FIG. 17). In some cases, before this returning operation of the curve sensor 20 is completed, a leading end of a subsequent sheet P4 abuts against the surface 20*b* of the curve sensor 20. In such cases, an impact applied to the leading end of the subsequent sheet P4 is further increased.

This is because a feeding position of the trailing end of the sheet P3 is also lowered by lowering the guide surface to result in an increase in rotation amount of the curve sensor 20 and therefore a time required for returning the position of the curve sensor to the stand-by position is also increased with the increased rotation amount of the curve sensor 20. That is, a rotation locus of the curve sensor 20 in FIG. 16 is increased from C1 to C2.

In this way, when the impact between the leading end of the subsequent sheet P4 and the curve sensor 20 during the contact therebetween is increased, there is also a possibility that the unfixed toner image in the leading end side of the subsequent sheet P4 is scattered.

Therefore, in this embodiment, a constitution in which also the impact when the leading end contacts the flag portion 20F is suppressed was employed. In FIG. 1, (*a*) and (*b*) show the sheet feeding guide 18 in this embodiment. FIG. 2 is an enlarged perspective view of the sheet feeding guide 18 shown in FIG. 1.

Figure 1:
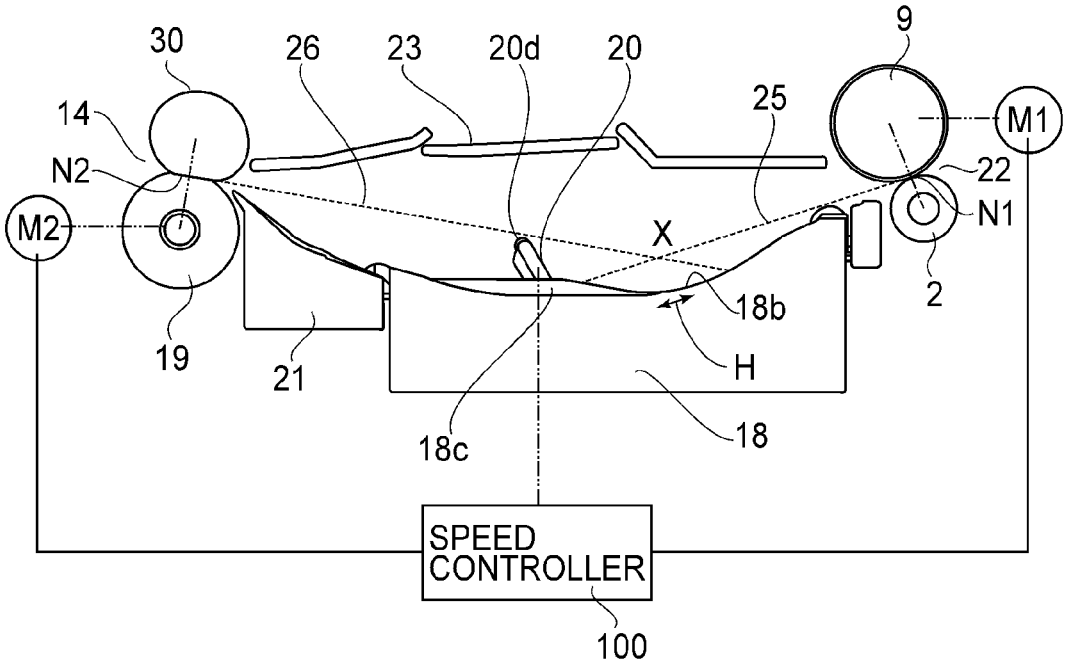
In FIG. 1, (a) and (b) are illustrations each showing a sheet feeding guide of an image forming apparatus according to Embodiment 1.
Figure 1:
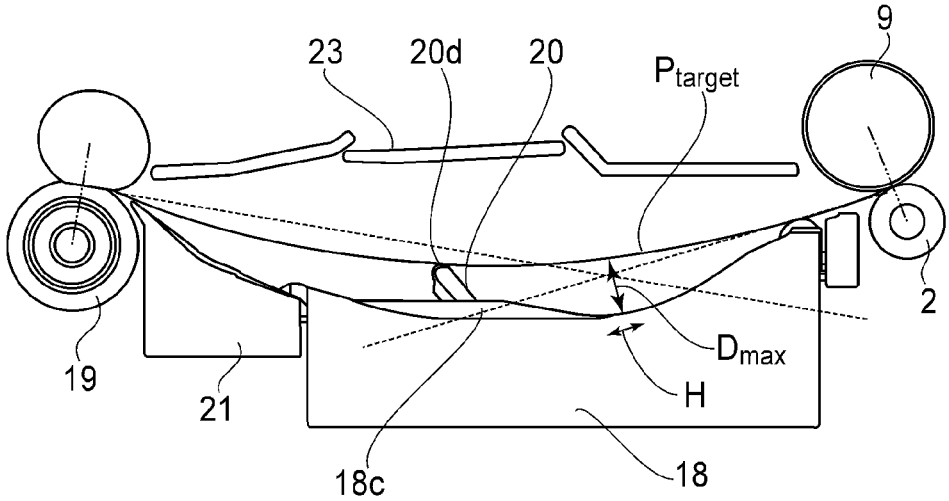
Figure 2:
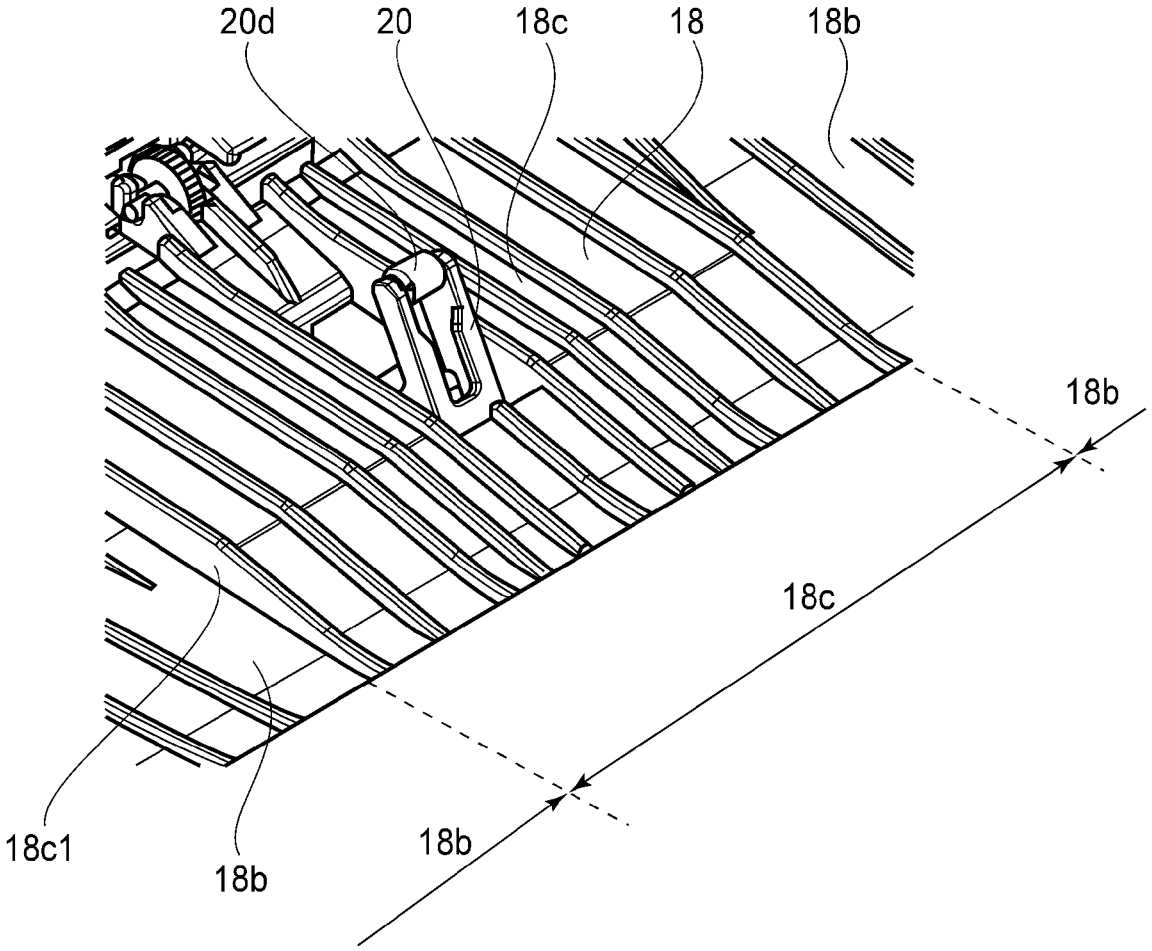
FIG. 2 is an enlarged perspective view of the sheet feeding guide shown in FIG. 1.
Figure 4:
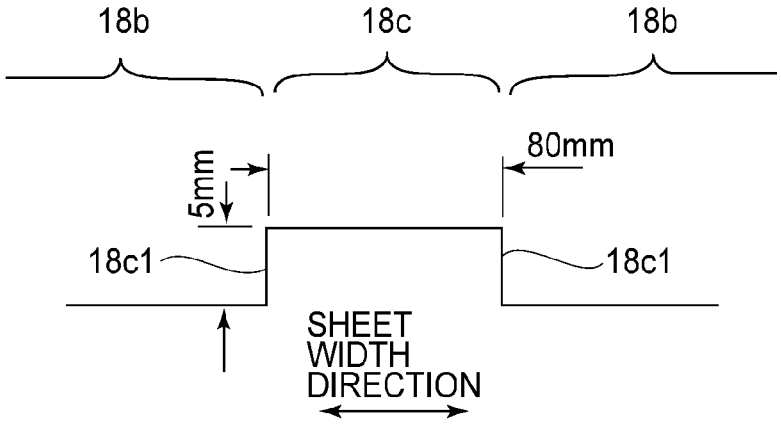
FIG. 4 is a schematic view of a B-B cross section shown in FIG. 3.

Specifically, as shown in FIG. 1, the guide surface 18*c* of the sheet feeding guide 18 in the neighborhood of the curve sensor 20 is projected relative to the guide surface 18*b* at portions other than the neighborhood of the curve sensor 20. That is, with respect to the sheet feeding direction, the guide surface in the position where the sheet detecting portion (curve sensor) 20 is provided is shaped, with respect to a direction perpendicular to the sheet feeding direction, such that a first region where the curve sensor 20 is provided is higher (in level) than second regions 18*b* each remoter from the curve sensor 20 than the first region 18*c*. A height position of the guide surface 18*c* in the neighborhood of the curve sensor 20 is kept at the same level as the guide surface 18*a* in Comparison Example. The projected-shaped guide surface 18*c* is provided with a stepped portion 18*c*1 at each of ends thereof with respect to the widthwise direction of the sheet P (FIGS. 2 and 4).

By forming the guide surface 18*c* in the projected shape, a tilt angle of the curve sensor 20 during the sheet passing is maintained at a necessary minimum level. Further, even when a continuous feeding interval of the sheets P is minimized in order to increase a print possessing speed of the image forming apparatus, the subsequent sheet is prevented from abutting against the curve sensor 20 before the returning operation of the curve sensor 20 is completed. As a result, scattering of the unfixed toner image in the leading end side of the subsequent sheet was suppressed.

Further, as shown in FIG. 2, the rotatable roller 20*d* was disposed at the end portion, of the curve sensor 20, as a sliding portion (sheet sliding position) of the curve sensor 20 with the sheet P. As a result, a feeding property of the sheet P is stabilized. In addition, a degree of the sliding between the curve sensor 20 and the sheet P is minimized so that also an increase in amount of triboelectric charges generated by the sliding of the sheet P on the curve sensor 20 is suppressed and thus the unfixed toner image on the sheet P is prevented from being electrically discharged and disordered.

Figure 3:
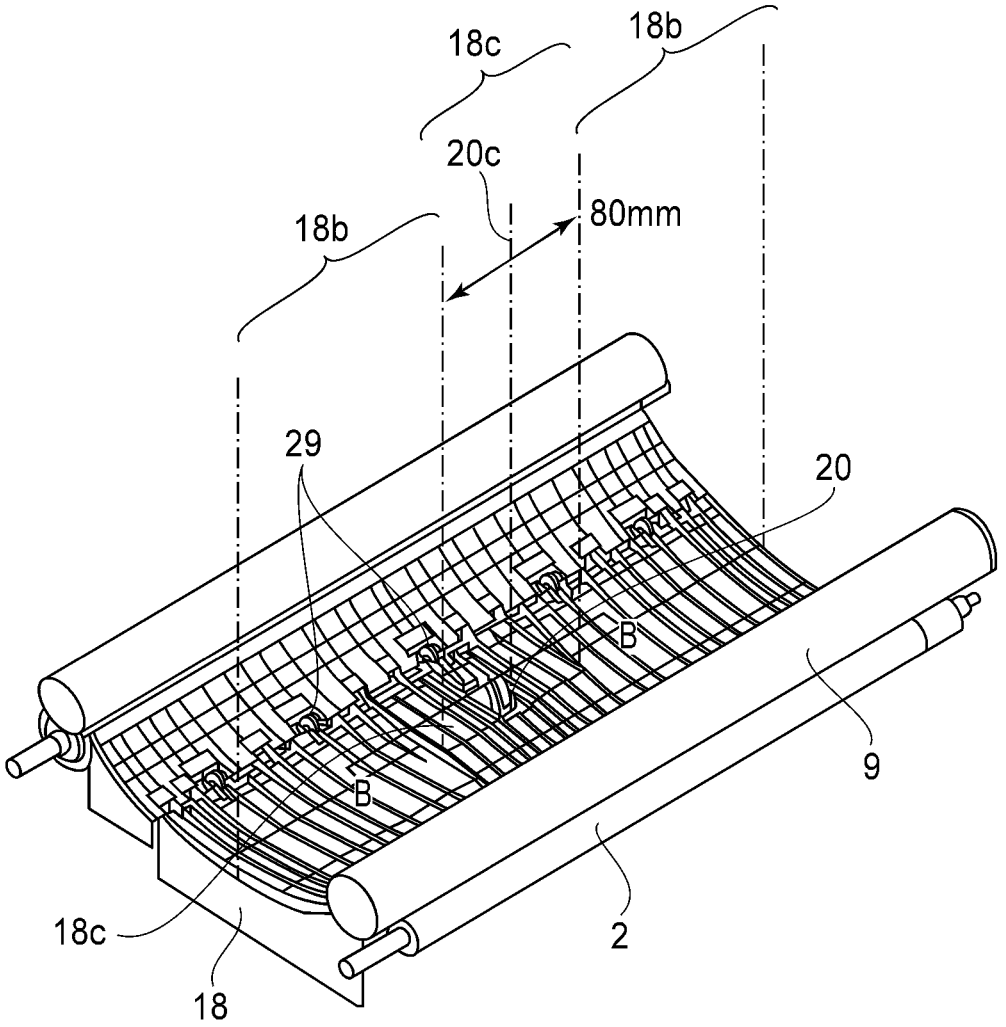
FIG. 3 is a perspective view of the sheet feeding guide shown in FIG. 1.
Figure 5:
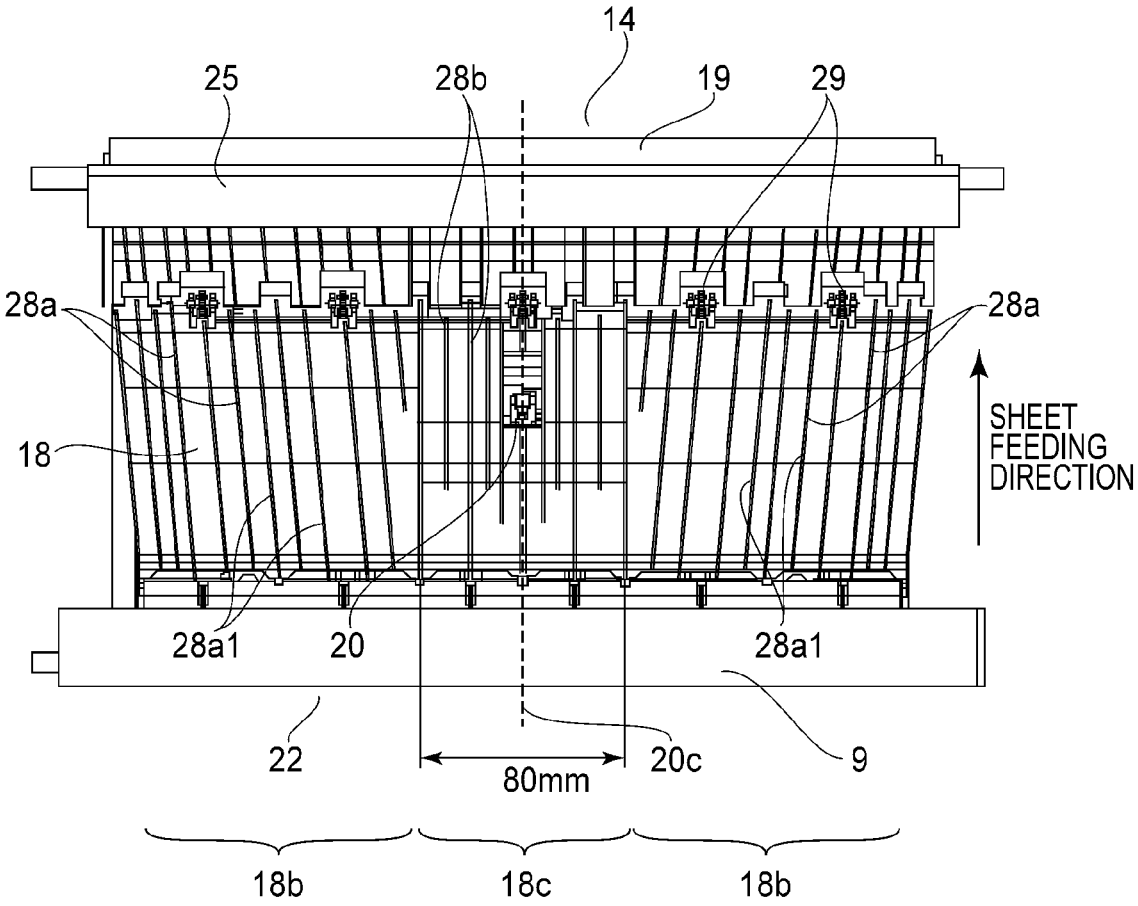
FIG. 5 is a schematic view for illustrating a rib shape of the sheet feeding guide shown in FIG. 1.

FIG. 3 is a perspective view of the sheet feeding guide 18 in this embodiment. As shown in FIG. 3, end portions of the guide surfaces 18*b* where a distance therefrom to the sheet P during generation of the non-uniform curve are lower (in level) than the guide surface 18*c* in the neighborhood of the curve sensor 20 in order to prevent the end portions from sliding with the widthwise end portions of the sheet P when the sheet P causes the non-uniform curve. In this embodiment, the projected-shaped guide surface 18*c* in the neighborhood of the curve sensor 20 was about 80 mm in dimension (width) with the flag of the curve sensor 20 as the center (FIGS. 3 and 5). In FIG. 5, the center of the flag is represented by 20*c*. For reference, a B-B cross section in FIG. 3 is shown in FIG. 4.

FIG. 5 is an illustration of a rib shape of the sheet feeding guide 18, and is a top plan view of the sheet feeding guide 18 having the guide surfaces 18*b* and 18*c*.

The shape of the plurality of ribs 28*a* provided on the guide surfaces 18*b* are, as shown in FIG. 5, disposed in a line-symmetrical manner with respect to the sheet widthwise center line 20*c* and extend radially. That is, the ribs 28*a* extend outward in an open direction toward the downstream side of the sheet feeding direction. This is because the influence of the sliding of the sheet P, at the widthwise end portions thereof, with the ribs 28 on the sheet P feeding performance is eliminated. For example, the sheet P after the fixing causes curl in some cases. When the sheet P having the curl is turned upside down for performing the double-side printing and then is fed again from the transfer portion 22 to the fixing portion 14, also positions of the widthwise end portions of the sheet P are liable to vary not a little.

As in this embodiment, the ribs 28*a* are disposed radially with respect to the sheet feeding direction, so that even when the widthwise end portions of the sheet P are positioned in any positions, a state in which the widthwise end portions of the sheet continuously slide with end surfaces 28*a*1 of the ribs 28*a* is eliminated. For that reason, it is possible to prevent the sheet P from being caught by the ribs 28*a* to skew and from causing corner creases.

However, within the projected-shaped guide surface 18*c* in the neighborhood of the curve sensor 20, the ribs 28*c* are shaped in a straight shape in parallel to the feeding direction of the sheet P. A dimension of the projected-shaped guide surface 18*c* is made smaller than a width of a minimum regular-sized sheet P usable in the image forming apparatus. In a region of the guide surface 18*c* in which there is no fear of the sliding with the widthwise end portions of the sheet P, by shaping the ribs 28*b* so as to extend in parallel to the feeding direction of the sheet P, the following effect is obtained. That is, an effect of minimizing a slidable section between the sheet P and the ribs 28*b* when the sheet P passes through the sheet feeding guide 18 to stabilize also the attitude of the sheet P with respect to the widthwise direction of the sheet P when the leading end of the sheet P enters the curve sensor 20.

As described above, by constituting the guide surfaces 18*b* and 18*c* of the sheet feeding guide 18 as in the above-described manner, the impact applied from the curve sensor 20 onto the sheet P was capable of being ensured so as to be comparable to or more than that in Comparison Example. Further, the guide surfaces 18*b* corresponding to the end portions of the sheet P, with respect to the sheet feeding direction, where the non-uniform curve amount of the sheet P is largest are made lower in level than the guide surface 18*c* in the neighborhood of the curve sensor 20, and therefore also a degree of tolerance with respect to the non-uniform curve of the sheet P can be maintained.

Here, as shown in FIG. 1, the position of the curve sensor 20 is downstream of intersection point X of a nip line 25 of the transfer nip N1 and a nip line 26 of the fixing nip N2 with respect to the sheet feeding direction. In other words, the intersection point X is positioned between the transfer nip N1 and the curve sensor 20. Here, the nip line refers to a line segment which is perpendicular to a line segment connecting roller centers for an associated one of the transfer nip N1 and the fixing nip N2 and which is a tangential line of the associated rollers.

This is based on the following reason. The non-uniform curve of the sheet P is generated roughly from the intersection point X of the nip lines as a starting point, and therefore an effect of preventing the contact between the sheet P and the sheet feeding guide 18 caused due to the non-uniform curve is highest by disposing the guide surface 18*b* such that a point substantially below the intersection line X is a lowest point of the guide surface 18*b*. Further, the curve sensor 20 is disposed in the downstream side, with respect to the sheet feeding direction, where the behavior of the sheet P is stable relative to that at the intersection point X of the nip lines as the starting point of the non-uniform curve, whereby it is possible to detect the sheet attitude and the curve amount of the sheet P with high accuracy. Therefore, the guide surface of the sheet feeding guide may preferably have a most deeply recessed region in a region between the transfer portion and the sheet detecting portion. The most deeply recessed region is indicated as H in (a) and (b) of FIG. 1. Further, the region H may more preferably be provided substantially just below the intersection line X of the nip lines of the transfer and fixing nips. Incidentally, the region H in Comparison Example shown in FIG. 8 is positioned in the downstream side of the sheet detecting portion with respect to the sheet feeding direction.

Incidentally, the most deeply recessed region H is a region where a distance (depth) from the target attitude (predetermined feeding attitude) Ptarget of the sheet P shown in (b) of FIG. 1 is a largest (deepest) distance Dmax. In the image forming apparatus in this embodiment, a length of the guide surface (i.e., a length of a curved surface along the guide surface) from the transfer nip to the fixing nip is 170 mm, but the region H where the distance is Dmax may preferably be 20-50 mm. Further, the distance Dmax may preferably be 10-20 mm. In the image forming apparatus in this embodiment, the length of the region H (with respect to the sheet feeding direction) is set at 30 mm, and Dmax is set at 12 mm.

Further, with respect to the sheet P passing through the transfer portion 22, by passing the leading end of the sheet P through the guide surface 18*b* and then the curve sensor 20 without directly contacting the curve sensor 20, it is also possible to obtain an effect of alleviating the impact at the time of contact the back surface of the leading end of the sheet P and the curve sensor 20.

By the above constitution, even when the sheet P causes the non-uniform curve, the sheet P can be fed while stably maintaining the attitude thereof without contacting the sheet feeding guide 18. By suppressing the impact at the time of the contact between the back surface of the leading end of the sheet P and the curve sensor 20, the unfixed toner image on the sheet P is prevented from being disordered. It became possible to solve both of problems of the abrasion of the sheet P with the upper feeding guide caused due to the non-uniform curve of the sheet P and the scattering of the image generated in the leading end side of the subsequent sheet without providing a plurality of curve sensors 20 with respect to the widthwise direction of the sheet P.

Embodiment 2

Another embodiment of the image forming apparatus will be described. The image forming apparatus in this embodiment has the same constitution as that of the image forming apparatus in Embodiment 1 except that a shape of the guide surface 18*c* of the sheet feeding guide 18 is different from that in Embodiment 1. The same constitution as that of the image forming apparatus in Embodiment 1 will be described while quoting the explanation of the constitution of the image forming apparatus in Embodiment 1.

Figure 6:
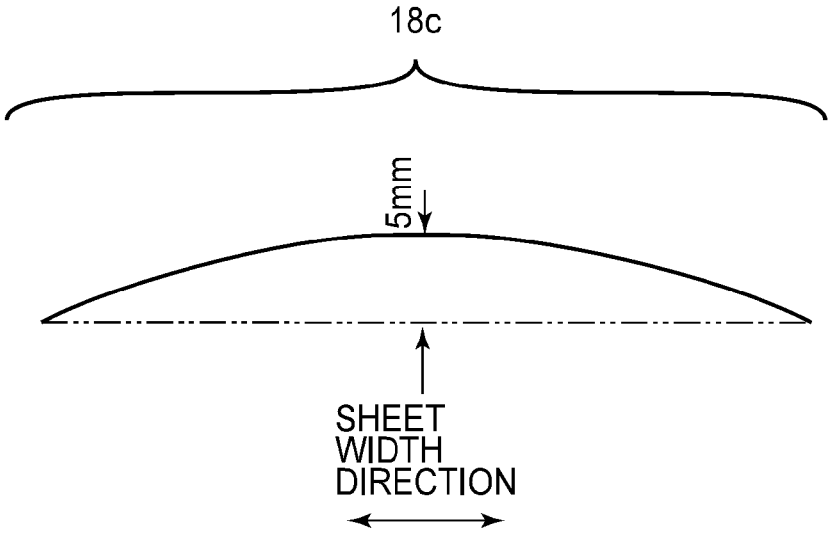
FIG. 6 is a schematic view showing a sheet feeding guide of an image forming apparatus according to Embodiment 2.

In the image forming apparatus in Embodiment 1, the shape of the guide surface 18*c* of the sheet feeding guide 18 is the projected shape having the stepped portions 18*c*1 in both sides thereof with respect to the sheet feeding direction as shown in FIG. 4, but in this embodiment, the shape of the guide surface 18*c* is a projected shape providing a smoothly curved surface as a whole as shown in FIG. 6.

FIG. 6 is a schematic view showing a longitudinal cross-section of the guide surface 18*c* of the sheet feeding guide 18 in the image forming apparatus in this embodiment. A cross-sectional direction of the guide surface 18*c* shown in FIG. 6 corresponds to the B-B cross section in FIG. 3.

As in this embodiment, even when the guide surface 18*c* is shaped in the projected shape providing the smoothly curved surface in the entire region with respect to the sheet feeding direction, a sufficient distance of the widthwise end portions of the sheet P is ensured from an ordinary feeding position. For that reason, even in the case where the sheet P causes the non-uniform curve, it is possible to prevent the contact between the sheet P and the sheet feeding guide 18.

Further, when the small-sized sheet P which does not readily cause the non-uniform curve relative to other sheets P is fed, the leading end of the sheet P is fed along the smooth guide surface 18*c* in cross-sectional shape, and therefore the shape of the guide surface 18*c* also contributes to sheet feeding stability.

In this way, depending on the sheet size used in the image forming apparatus, a profile of the cross-sectional shape of the guide surface 18*c* of the sheet feeding guide 18 may preferably be selected appropriately.

As described above, the image forming apparatuses in Embodiments 1 and 2 are capable of feeding the sheet P while stably maintaining the attitude of the sheet P by the curve sensor 20 without causing a heavy impact which otherwise might be caused by a conventional contact between the sheet P and the sheet feeding guide 18 even when the sheet P causes the non-uniform curve. Further, the feeding attitude of the sheet P from the transfer portion 22 to the fixing portion 14 can be stabilized while maintaining a simple constitution without inviting an increase in cost, so that it is possible to compatibly realize a stable feeding performance of the sheet P and a high image quality.

Another Embodiment

In place of the fixing roller 30 of the fixing portion 14, a rotatable heating member such as a fixing film or a fixing belt may also be used. In this case, as a heating member for heating the rotatable heating member, a ceramic heater or a coil for generating magnetic flux can be appropriately used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 029062/2013 filed Feb. 18, 2013 and 012361/2014 filed Jan. 27, 2014, which are hereby incorporated by reference.

What is claimed is:

1. An image forming apparatus comprising:

a transfer portion for transferring an image onto a sheet while feeding the sheet through a transfer nip;

a fixing portion for fixing the image on the sheet while feeding the sheet, fed from said transfer portion, through a fixing nip;

a sheet feeding guide, provided between said transfer portion and said fixing portion, having a guide surface for guiding the sheet;

a sheet detecting portion, provided at a position between said transfer portion and said fixing portion, for detecting the sheet; and a controller for controlling a sheet feeding speed of at least one of said transfer portion and said fixing portion depending on an output of said sheet detecting portion so that a feeding attitude of the sheet fed while being sandwiched at both of the transfer nip and the fixing nip is maintained in a predetermined feeding attitude, wherein the guide surface of said sheet feeding guide has a most recessed region in a region between said transfer portion and said sheet detecting portion, wherein the guide surface in a position where said sheet detecting portion is provided with respect to a sheet feeding direction has a first region where said sheet detecting portion is provided and a second region spaced from said sheet detecting portion more than the first region with respect to a direction perpendicular to the sheet feeding direction, and wherein the first region is higher than the second region with respect to a direction perpendicular to the guide surface.

2. An image forming apparatus according to claim 1, wherein the most recessed portion is provided substantially right below a point of intersection of a nip line of the transfer nip and a nip line of the fixing nip.

3. An image forming apparatus according to claim 1, wherein the guide surface is provided with ribs extending in the sheet feeding direction, and wherein the ribs provided in the second region extend in a direction in which the ribs open outward toward a downstream side with respect to the sheet feeding direction.

4. An image forming apparatus according to claim 3, wherein the ribs provided in the first region are parallel to the sheet feeding direction.

5. An image forming apparatus according to claim 1, wherein a width of the first region with respect to the direction perpendicular to the sheet feeding direction is smaller than a width of a minimum regular-sized sheet usable in said image forming apparatus.

6. An image forming apparatus according to claim 1, wherein said sheet detecting portion includes a sheet contact portion rotatable by contact with the sheet, and wherein the sheet contact portion is provided with a roller at an end portion thereof.

7. An image forming apparatus comprising:

a transfer portion for transferring an image onto a sheet while feeding the sheet through a transfer nip;

a fixing portion for fixing the image on the sheet while feeding the sheet, fed from said transfer portion, through a fixing nip;

a sheet feeding guide, provided between said transfer portion and said fixing portion, having a guide surface for guiding the sheet;

a sheet detecting portion, provided at a position between said transfer portion and said fixing portion, for detecting the sheet; and a controller for controlling a sheet feeding speed of at least one of said transfer portion and said fixing portion depending on an output of said sheet detecting portion so that a feeding attitude of the sheet fed while being sandwiched at both of the transfer nip and the fixing nip is maintained in a predetermined feeding attitude, wherein the guide surface of said sheet feeding guide has a most recessed region in a region between said transfer portion and said sheet detecting portion, wherein said transfer portion is provided so that the nip line of the transfer nip crosses with the guide surface of said sheet feeding guide, and said fixing portion is provided so that the nip line of the fixing nip crosses with the guide surface of said sheet feeding guide, and wherein the most recessed portion is provided substantially right below a point of intersection of a nip line of the transfer nip and a nip line of the fixing nip.

8. An image forming apparatus according to claim 7, wherein the guide surface in a position where said sheet detecting portion is provided with respect to a sheet feeding direction has a first region where said sheet detecting portion is provided and a second region spaced from said sheet detecting portion more than the first region with respect to a direction perpendicular to the sheet feeding direction, and wherein the first region is higher than the second region with respect to the direction perpendicular to the guide surface.

9. An image forming apparatus according to claim 8, wherein the guide surface is provided with ribs extending in the sheet feeding direction, and wherein the ribs provided in the second region extend in a direction in which the ribs open outward toward a downstream side with respect to the sheet feeding direction.

10. An image forming apparatus according to claim 9, wherein the ribs provided in the first region are parallel to the sheet feeding direction.

11. An image forming apparatus according to claim 8, wherein a width of the first region with respect to the direction perpendicular to the sheet feeding direction is smaller than a width of a minimum regular-sized sheet usable in said image forming apparatus.

12. An image forming apparatus according to claim 7, wherein said sheet detecting portion includes a sheet contact portion rotatable by contact with the sheet, and wherein the sheet contact portion is provided with a roller at an end portion thereof.

* * * * *